US005178290A

United States Patent [19]

Ota et al.

[11] Patent Number: 5,178,290

[45] Date of Patent: Jan. 12, 1993

[54] CONTAINER HAVING COLLAPSE PANELS WITH INDENTATIONS AND REINFORCING RIBS

[75] Inventors: Akiho Ota, Funabashi; Takao Iizuka, Matsudo, both of Japan

[73] Assignee: Yoshino-Kogyosho Co., Ltd., Tokyo, Japan

[21] Appl. No.: 690,665

[22] Filed: Apr. 24, 1991

Related U.S. Application Data

[63] Continuation-in-part of Ser. No. 570,973, Aug. 22, 1990, abandoned, which is a continuation of Ser. No. 760,420, Jul. 30, 1985, abandoned.

[51] Int. Cl.[5] ..... B65D 23/00

[52] U.S. Cl. ..... 215/1.00 C; 270/675

[58] Field of Search ..... 215/1 C; 220/669, 675; D9/551, 557, 556, 553, 564, 566, 570

[56] References Cited

U.S. PATENT DOCUMENTS

| | | | |
|---|---|---|---|
| D. 229,541 | 12/1973 | Anderson | D9/378 |
| D. 240,968 | 8/1976 | Hurst | D9/510 X |
| D. 294,117 | 2/1988 | Rogler et al. | D9/390 |
| 3,325,031 | 6/1967 | Singler | 215/1 C |
| 3,397,724 | 8/1968 | Bolen et al. | 215/1 C |
| 3,536,223 | 10/1970 | Muhlhoff et al. | 215/1 C |
| 3,708,082 | 1/1973 | Platte | 215/1 C |
| 3,926,341 | 12/1975 | Lhoest | 215/1 C X |
| 3,931,074 | 1/1976 | Gomez | 215/1 C X |
| 4,379,099 | 4/1983 | Ota et al. | 215/1 C X |
| 4,387,816 | 6/1983 | Weckmam | 215/1 C |
| 4,805,788 | 2/1989 | Ota | 215/1 C |

OTHER PUBLICATIONS

"Gatorade Tests Bottle of Future" Packaging, Oct. 1987.

*Primary Examiner*—Bryon P. Gehman
*Attorney, Agent, or Firm*—Oliff & Berridge

[57] ABSTRACT

A hollow blow-molded container of a biaxially oriented thermoplastic material in which the container walls contain collapse panels with indentations and reinforcing ribs to accommodate evacuation and permit fabrication of the container without deleterious changes in the appearance of the container. The indentations and ribs within the collapse panels effectively support the collapse panels during contraction of the contents of the container and prevent deformation during fabrication.

19 Claims, 7 Drawing Sheets

FIG. 3
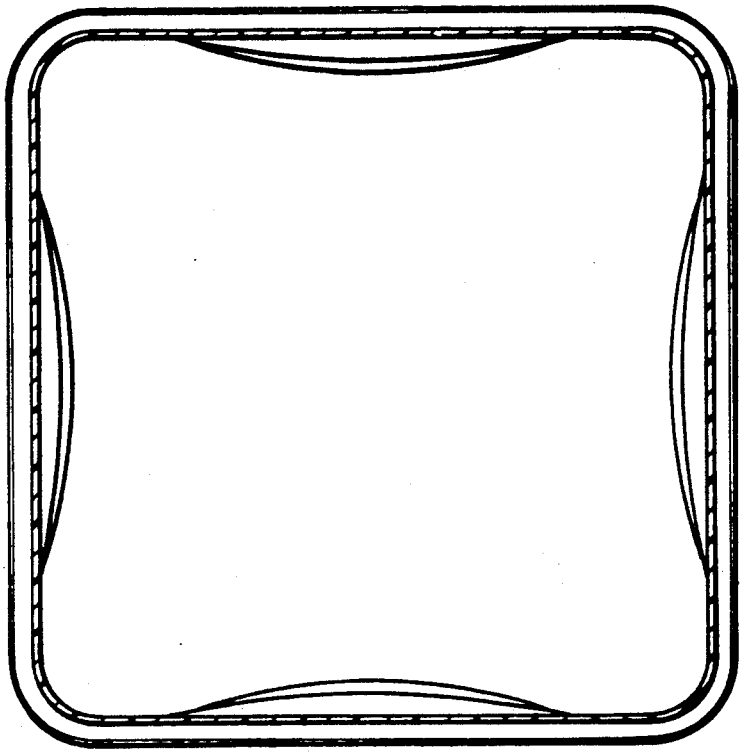
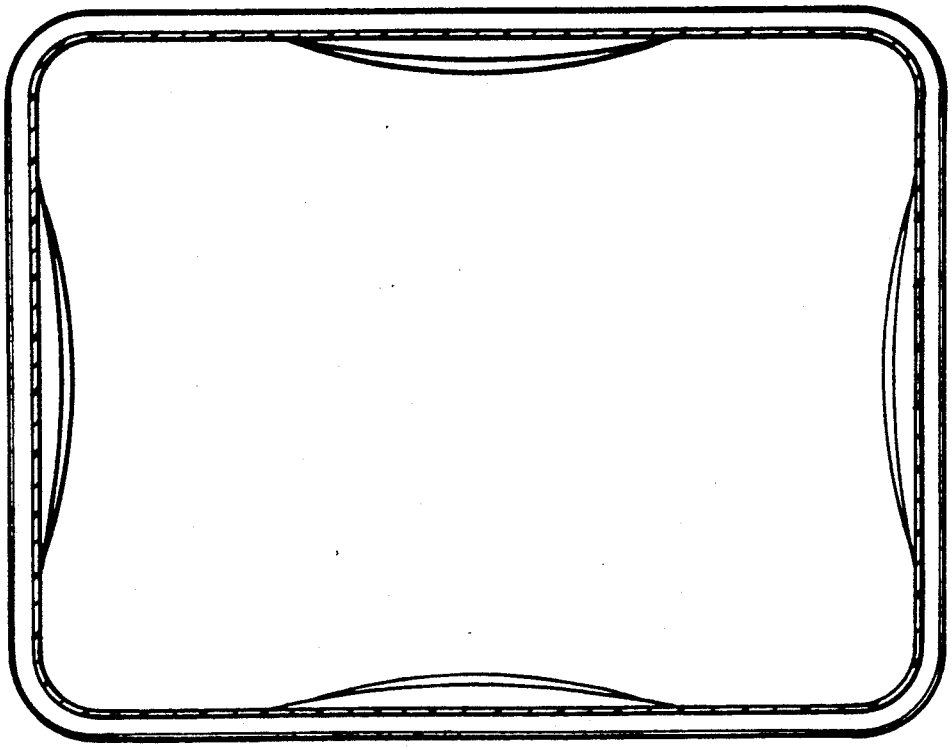
FIG. 4

CONTAINER HAVING COLLAPSE PANELS WITH INDENTATIONS AND REINFORCING RIBS

This application is a Continuation-in-Part of U.S. Ser. No. 07/570,973, filed Aug. 22, 1990 (now abandoned), which was a continuation of U.S. Ser. No. 06/760,420, filed Jul. 30, 1985 (now abandoned).

BACKGROUND OF THE INVENTION

The present invention relates to hollow blow-molded containers of a biaxially oriented thermoplastic material, and more particularly to thin-walled plastic containers configured to accommodate partial evacuation without adverse effects on their appearance.

Lightweight, thin-walled containers made of thermoplastic materials such as polyester resin and thermoplastic polymers containing at least 50% by weight polymerized nitrile-group-containing monomer (hereinafter "nitriles"), are well known in the container industry. For example, polyethylene terephthalate (PET) has a wide range of applications in the field of containers for foodstuffs, flavoring materials, cosmetics, beverages and so on. PET can be molded, by orientation-blowing, into transparent thin-walled containers having a high stiffness, impact strength and improved hygienic qualities with a high molding accuracy. Strong, transparent and substantially heat resistant containers may be produced by the biaxial-orientation blow-molding process in which a parison is oriented both laterally and longitudinally in a temperature range suitable, for such orientation. Nitrile and heat set PET containers are particularly heat resistant. Biaxially-oriented blow-molded containers have greater stiffness and strength as well as improved gas barrier properties and transparency.

When a thermoplastic container is filled with a hot liquid (such as a liquid sterilized at a high temperature) and sealed, subsequent thermal contraction of the liquid upon cooling results in a partial evacuation of the container which tends to deform the container walls. Backflow into a filling mechanism and the use of vacuum filling equipment during filling operations can similarly create a partial vacuum inside the container, resulting in its deformation. Such deformation typically concentrates at the mechanically weaker portions of the container, resulting in an irregular and commercially unacceptable appearance. Further, if the deformation occurs in an area where the label is attached to the container, the appearance of the label may be adversely affected as a result of container deformation.

By increasing the wall thickness of the container it is possible to some extent to strengthen the container walls and thus decrease the effects of vacuum deformation. However, increasing the wall thickness results in a substantial increase in the amount of raw materials required to produce the container and a substantial decrease in production speed. The resultant increased costs are not acceptable to the container industry.

A prior attempt to reduce the effects of vacuum deformation is disclosed in U.S. Pat. No. 3,708,082 to Platte. Platte discloses a container with four flat wall panels comprising the body portion of the container. A rib circumscribes the entire container in a region below the handle and serves to rigidify the side wall portions in a circumferential direction. The rib also acts as a hinge to allow limited inward collapsing of the container along selected regions.

Another prior approach to reduction of the effects of vacuum deformation is disclosed in Japanese Application No. 54-30654. In this approach, a container is provided with a plurality of recessed panels, separated by lands, which allow uniform controlled inward deformation so that vacuum effects are accommodated in a uniform manner without adverse effects on the appearance of the container.

Prior art approaches have included the use of collapse panels (i.e., indented surface areas which provide for controlled, quantified collapse) to overcome thermal deformation of the container. However, problems have developed in containers designed with large collapse panels, i.e., panels having a width greater than 30–40 mm. While large collapse panels accommodate a greater degree of controlled deformation, as the width of the collapse panel increases, the strength of the container body decreases. Thus, bulging in the area of the collapse panels occurs, even with a partial vacuum inside the container. Furthermore, formation of heat set PET containers with large collapse panels involves serious shrinkage control problems which result in an undesirably rippled surface of the container.

DESCRIPTION OF THE INVENTION

The present invention relates to a hollow blow-molded container of biaxially-oriented thermoplastic material, wherein the container walls contain collapse panels, and the collapse panels contain indentations, and further the indentations contain reinforcing ribs. Such a container can accommodate evacuation without deleterious changes in the container's strength or appearance. More specifically, a thin-walled plastic container of the present invention comprises a bottom section, a neck section, and a body section extending between the neck section and the bottom section, the body section including a plurality of collapse panels with at least one indentation within at least one of the collapse panels and one reinforcing rib extending within at least one of the at least one indentation.

As the size of a collapse panel becomes wider, the ability to achieve a controlled and uniform collapse of the container becomes more difficult. That is, as the volume of the container and width of the collapse panel become larger, there is a greater amount of shrinkage of hot-filled contents and therefore a greater likelihood of uneven deformation. Fabrication problems increase as well. It has now been discovered by the present inventors that by including indentations and reinforcing ribs within the collapse panels, collapse panels of greater widths (greater than 30–40 mm, and/or having a length to width ratio less than 4:1) can be utilized, thereby allowing for greater controlled deformation of the container than in containers with collapse panels only and further with reinforcing ribs only within collapse panels. As the area of the collapse panels is increased to accommodate a greater degree of controlled deformation, a greater number of indentations and reinforcing ribs is required.

The reinforcing ribs, coupled with the indentations, increase the strength of the collapse panels. Thus, the invention is particularly adapted to use with hot-fillable container materials, i.e., materials which safely permit filling of the container with contents at temperatures of 65°–100° C., more generally 75°–95° C. In this way, wider collapse panels can be utilized in the container, thereby accommodating even larger evacuation effects by controlled, uniform vacuum deformation. The indentations and reinforcing ribs also prevent bulging of the collapse panels when the vacuum is released. They are also effective to prevent bulging and rippling of large collapse panels in heat set PET containers upon removal from a mold.

BRIEF DESCRIPTION OF THE DRAWINGS

FIG. 3 is a cross-sectional view of a square container of the present invention.

FIG. 4 is a cross-sectional view of a rectangular container of the present invention.

DETAILED DESCRIPTION OF PREFERRED EMBODIMENTS OF THE INVENTION

Figure 1:
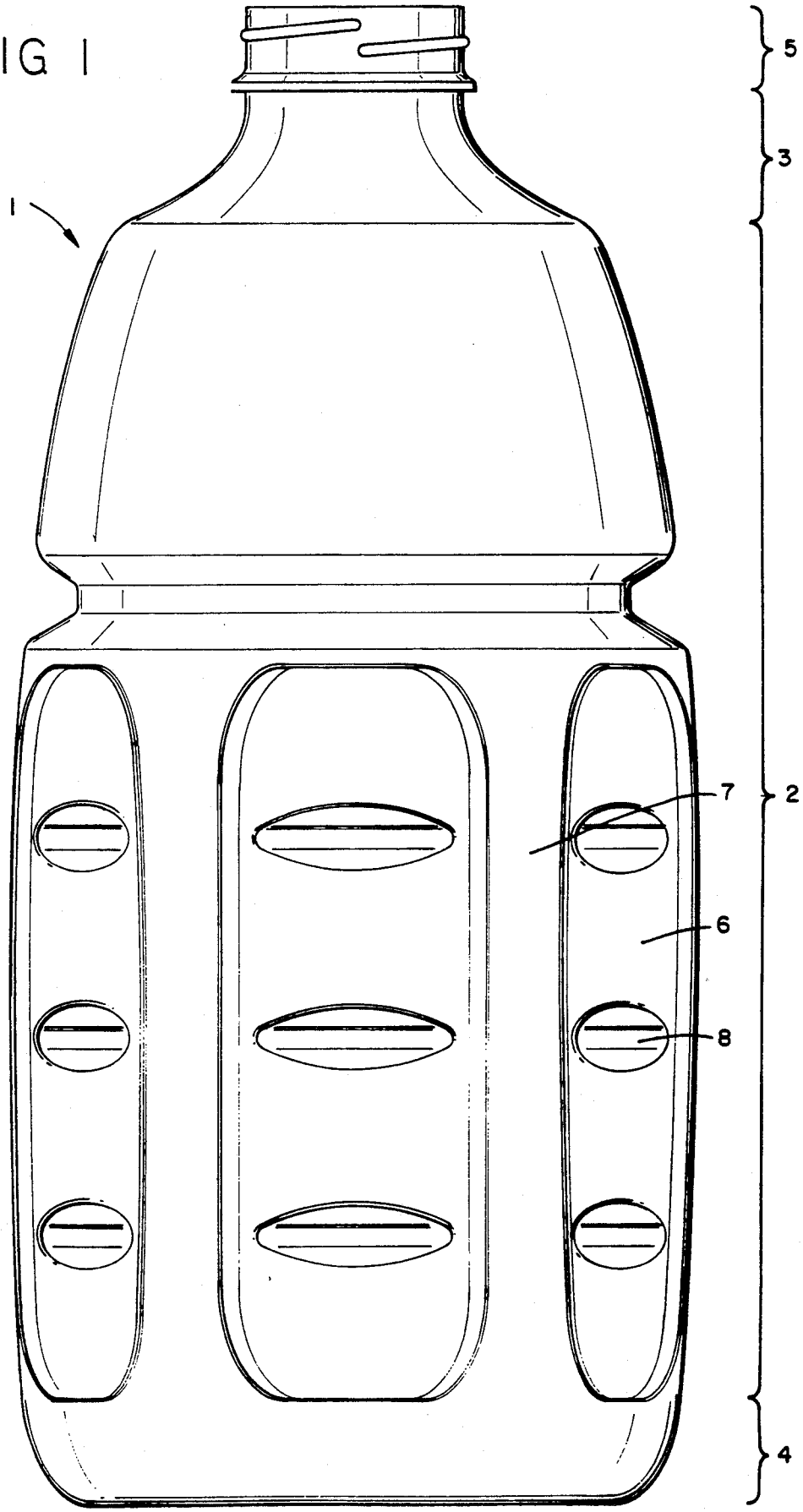
FIG. 1 is a side view of a round container having collapse panels with indentations and ribs of the present invention.
Figure 2:
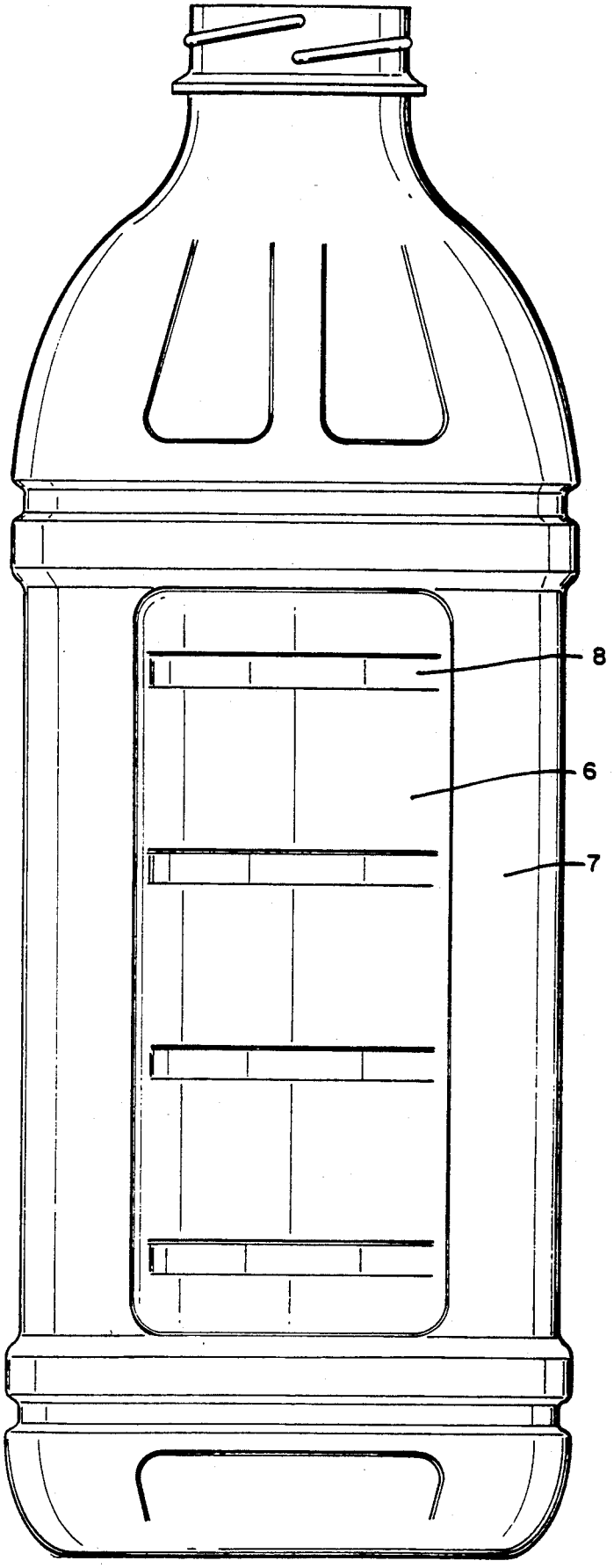
FIG. 2 is a side view of another container of the present invention.
Figure 5:
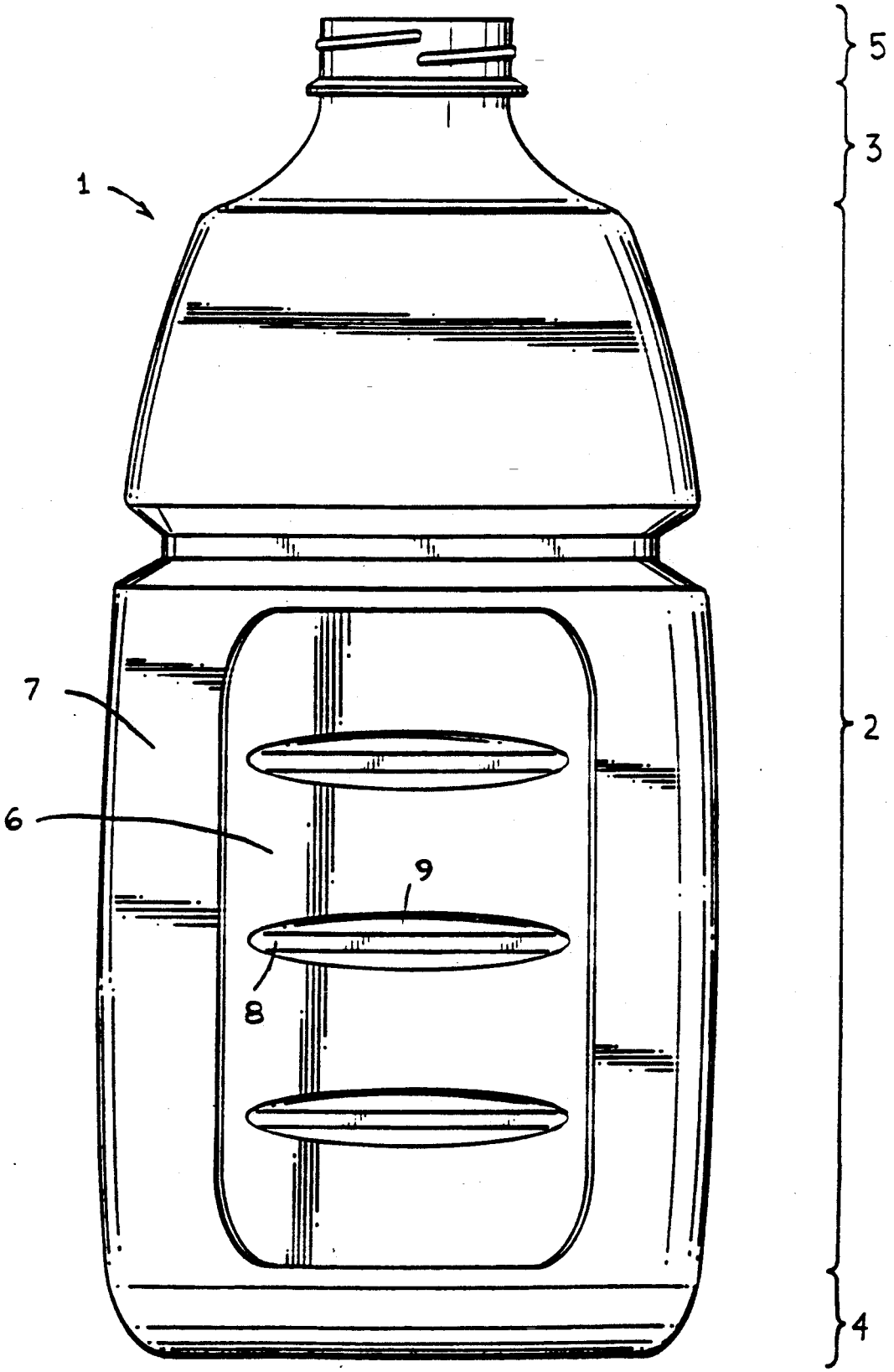
FIG. 5 is a side view of a square container of the present invention.
Figure 6:
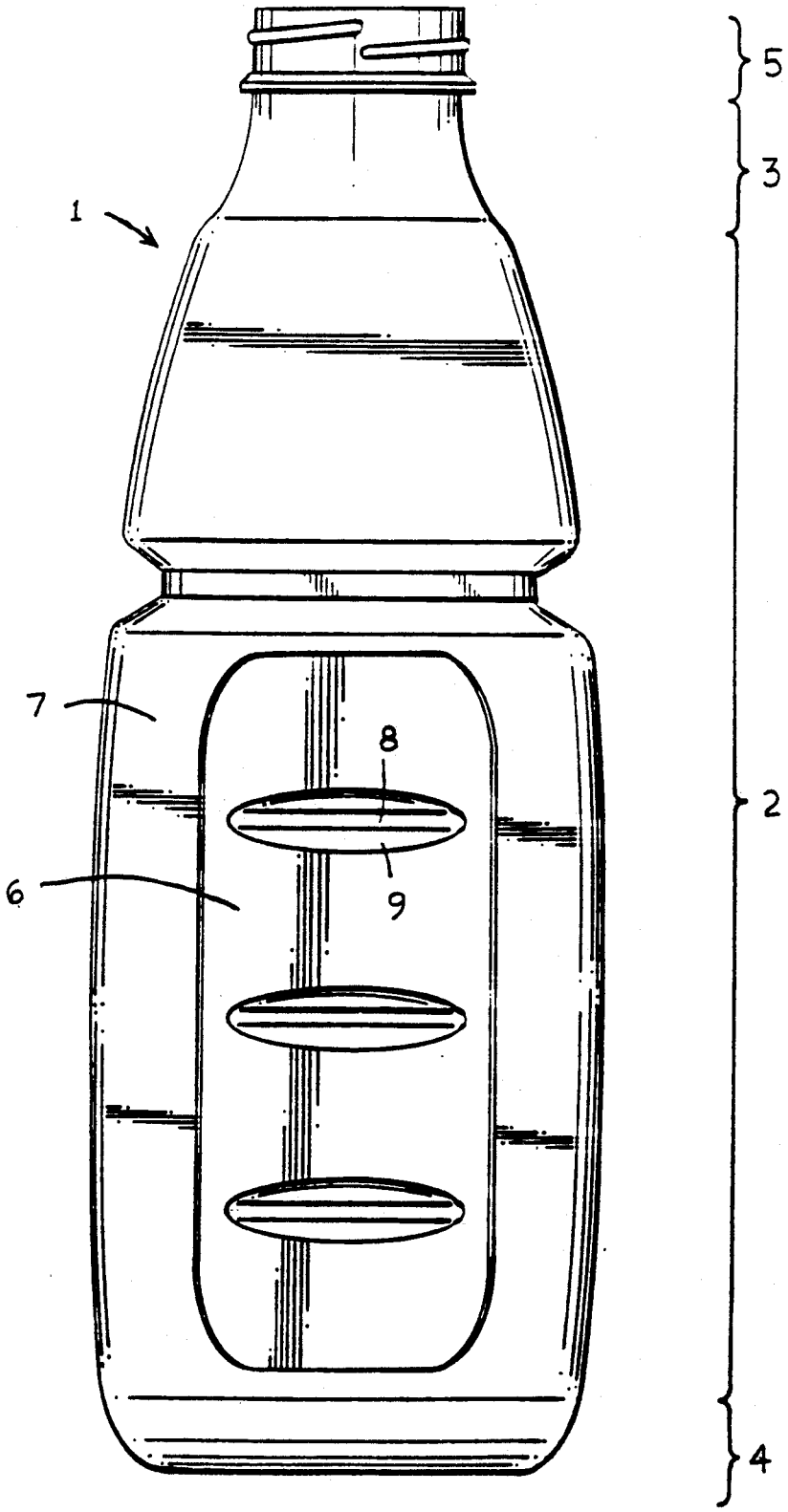
FIG. 6 is a side view of a rectangular container of the present invention.
Figure 7:
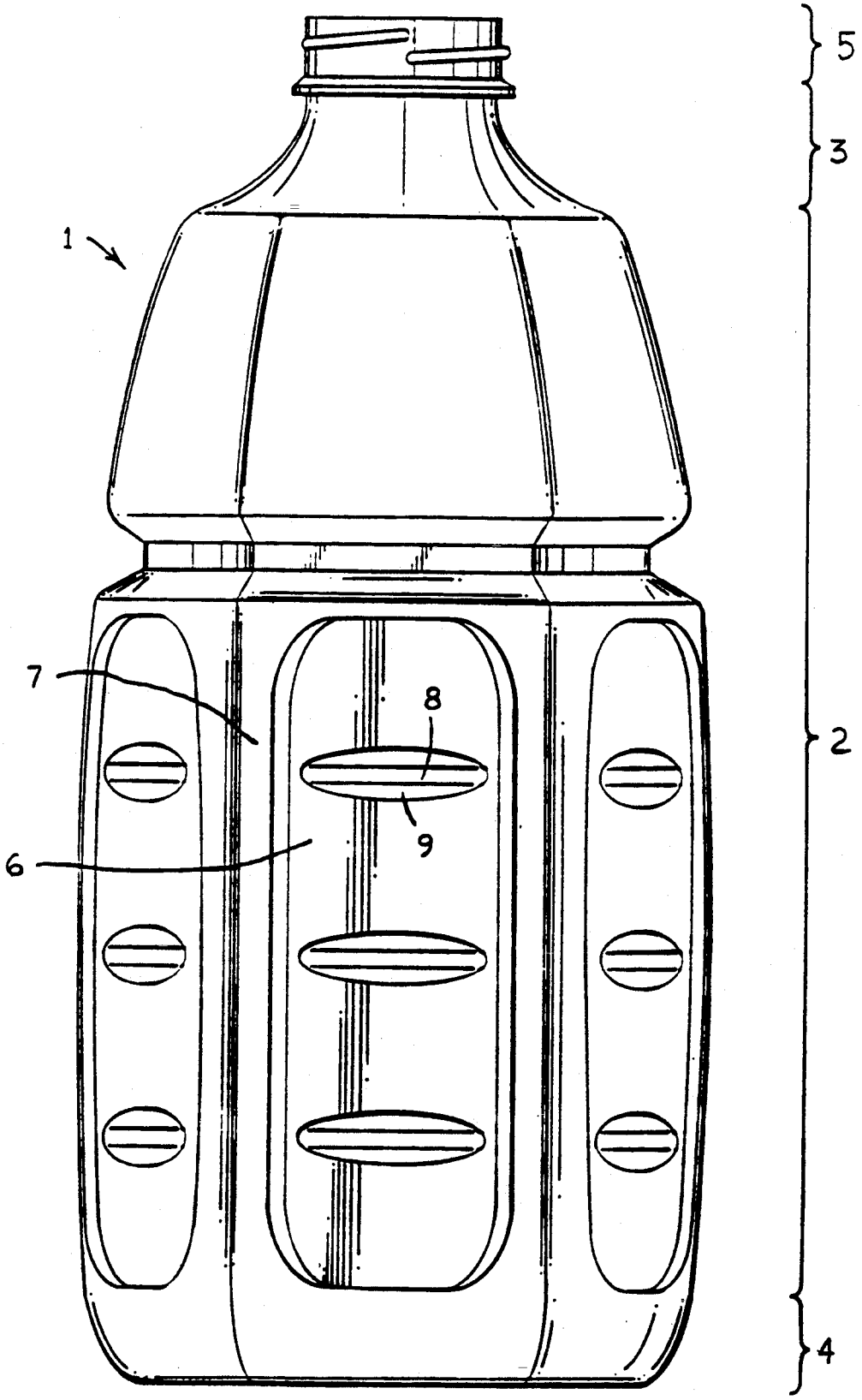
FIG. 7 is a side view of a hexagonal container of the present invention.
Figure 8:
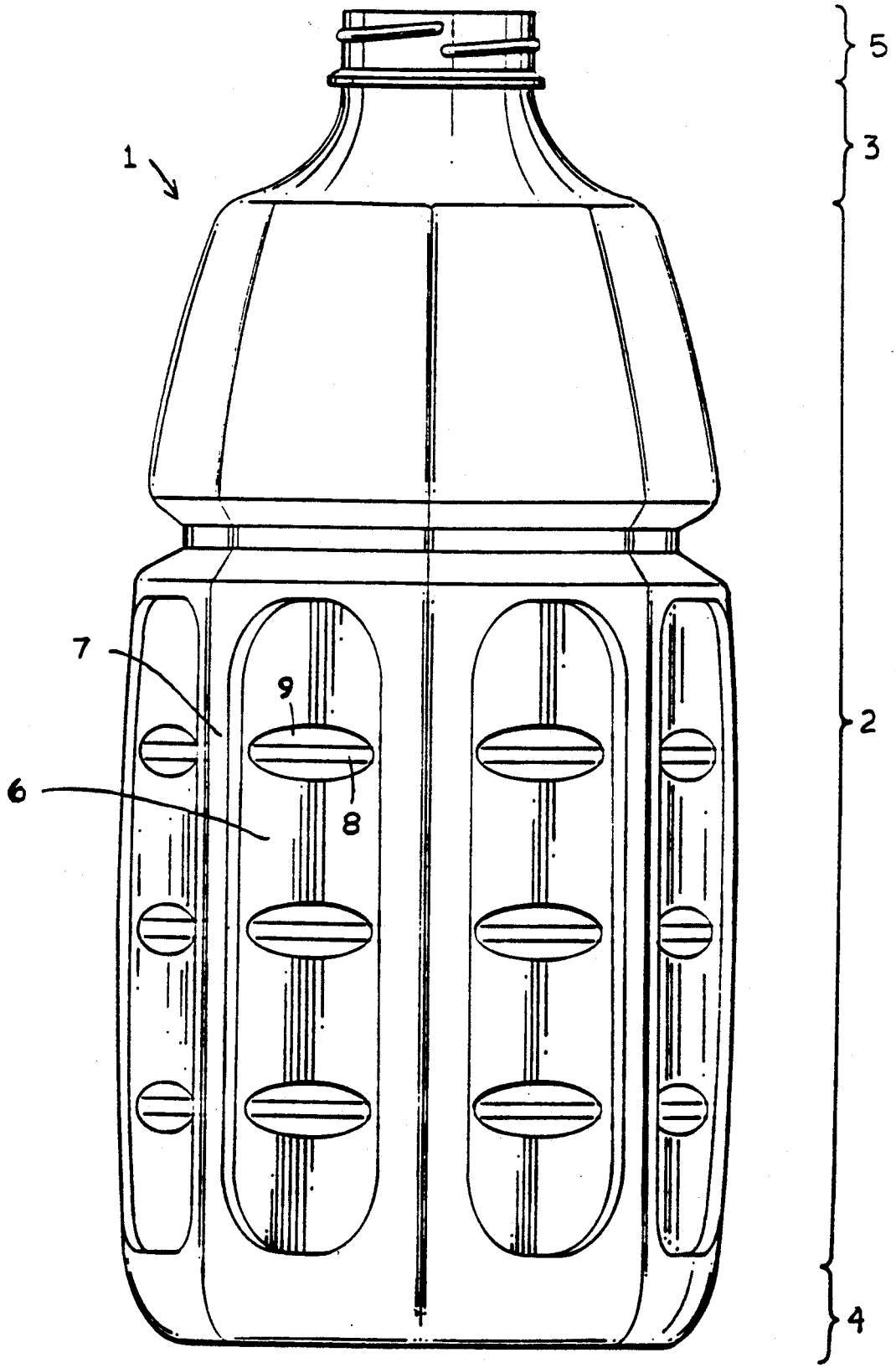
FIG. 8 is a side view of an octagonal container of the present invention.

Referring now to the drawings, FIG. 1 depicts a thin-walled blow-molded plastic container 1 which may be formed of polyethylene terephthalate (PET), which may be heat set, or a nitrile. The container 1 comprises a body section 2 having a shoulder portion 3. The body section can be of any cross-sectional shape, for example, polygonal such as rectangular (FIG. 6), square (FIG. 5), hexagonal (FIG. 7), octagonal (FIG. 8), or round (FIG. 1). The lower end of the body section 2 is closed off by bottom section 4. The body section 2 extends upwardly from the bottom section and tapers radially inwardly at the top of the body section to form the shoulder section 3 which terminates at neck section 5. The neck section 5 may include external threads for a closure (not shown) and the neck section 5 may be crystallized to provide thermal, chemical and mechanical strength in the unstretched neck section as disclosed, for instance, in U.S. Pat. No. 4,379,099.

The body portion 2 of the container is specifically configured to accommodate controlled changes of the volume of the container upon its partial evacuation. As shown in FIG. 1, indented collapse panels 6 are formed around the body section 2. A collapse panel 6 may be formed at each side of the polygonal body section 2, and adjacent collapse panels 6 are separated from each other by lands 7. Collapse panels may alternatively be formed on fewer than all sides of the container, for instance on alternating sides. The collapse panels are elongated along the longitudinal axis of the container, and have a generally rectangular or oval shape (FIG. 1). Each collapse panel may contain one or more indentations 9 and reinforcing ribs 8 which serve to strengthen the collapse panels 6. The reinforcing ribs 8, preferably indented, extend within the indentations 9 and do not extend into the land 7 separating adjacent collapse panels. Preferably, the length of the reinforcing ribs is substantially less than the width of the respective collapse panels.

The number of indentations per panel depends primarily on the height of the collapse panel, as well as the type and thickness of material forming the container. That is, different materials exhibit different degrees of resistance to deformation under vacuum and in the course of any heat setting, and the requisite number of indentations per collapse panel will change accordingly. Additionally, the conditions under which the container is filled and the nature of the contents to be filled into the container will affect the number of indentations required. The indentations are preferably so formed that the reinforcing ribs are spaced about 25–45 mm apart. For very wide panels or panels with a very low height:width ratio (e.g., less than about 2), closer spacing is preferred. In this case, the indentations may be so closely formed that the ribs are spaced not exceeding 25 mm apart. The determination of the number of indentations per panel based on the type of material of the container, the contents of the container and the temperature of filling can be determined by those of ordinary skill in the art upon routine experimentation.

It is additionally noted that by increasing the number of panels, whereby each panel has a smaller width, the ability of the container to absorb vacuum is not as good when compared with the case where larger width collapse panels, with the appropriate number of indentations and reinforcing ribs therein, are used. Similarly, collapse panels having too many indentations and ribs will not allow enough controlled deformation, defeating the purpose of the collapse panel.

The following examples will illustrate the invention, but are not intended to limit the scope of the patent as defined in the claims appended hereto.

EXAMPLES

A cross-sectionally round container of 64 ounce size was made with panels having a width of 46 mm and a length:width ratio of 2.7. There were no indentations and ribs in the panels. When the container was hot filled and then capped and cooled to room temperature, there was bulging in the panels. When the cap was removed and vacuum released, the bulging became even worse. The same container was then made with indentations and reinforcing ribs in the collapse panels. After hot filling and cooling to room temperature under the same conditions, there was no bulging in the panels. Likewise, when the bottle was uncapped and vacuum released, there was no bulging.

In another example, a cross-sectionally square 64 ounce container was made. The collapse panels were about 56 mm wide and had a length:width ratio of 2.8. When the container was removed from the mold, the panels had waviness which did not conform to the surface of the mold. When the container was hot filled, there was bulging in one or more panels both when the container was under vacuum and after the vacuum was released (uncapped). The bulging was even worse after uncapping. When the same container was made incorporating indentations and ribs in the panels, there were no problems either when removing the bottles from the mold or after hot filling under the same conditions.

Various modifications and alterations of the present invention will be readily apparent to persons skilled in the art. It is intended, therefore, that the foregoing be considered as exemplary and that the scope of the invention be limited only by the following claims.

We claim:

1. A thin-walled container made of thermoplastic material, comprising:

a bottom section;

a neck section; and a body section extending between said neck section and said bottom section;

said body section having a cross-section substantially of a shape selected from the group consisting of square, rectangular, hexagonal, octagonal and round;

said body section including a plurality of indented collapse panels each extending in a plane which provide controlled, quantified collapse upon exposure of an interior of said container to a partial vacuum, said collapse panels adjacent one another being separated by lands, at least one offset area offset from said plane extending within at least one of said plurality of collapse panels, and one indented reinforcing rib extending within said at least one offset area, said one indented reinforcing rib reducing distortion of said collapse panel while still permitting said quantified collapse.

2. The container of claim 1, wherein at least one offset area extends within each of said plurality of collapse panels, and one indented reinforcing rib extends within said at least one offset area in each of said collapse panels.

3. The container of claim 1, wherein said material is a hot-fillable container material.

4. The container of claim 1, wherein said material is polyethylene terephthalate.

5. The container of claim 4, wherein said material is heat-set.

6. The container of claim 1, wherein said material is a nitrile.

7. The container of claim 1, wherein said reinforcing rib is substantially shorter than a width of a collapse panel within which said reinforcing rib extends.

8. The container of claim 1, wherein said neck section is crystallized.

9. The container of claim 1, wherein said at least one of said collapse panels containing said at least one offset area and said one indented reinforcing rib has a width greater than 30 mm.

10. The container of claim 9, wherein said at least one of said collapse panels containing said at least one offset area and said one indented reinforcing rib has a width greater than 40 mm.

11. The container of claim 1, wherein a plurality of offset areas extend within said at least one of said plurality of collapse panels, and one indented reinforcing rib extends within each of said plurality of offset areas.

12. The container of claim 1, wherein a plurality of offset areas extend within each of said plurality of collapse panels, and one indented reinforcing rib extends within each of said plurality of offset areas.

13. A thin-walled container made of thermoplastic material, said material being a hot-fillable material and said container comprising a bottom section, a neck section, and a body section extending between said neck section and said bottom section, said body section having a cross-section substantially of a shape selected from the group consisting of square, rectangular, hexagonal, octagonal and round; said body section including at least one longitudinally elongated indented collapse panel extending in a plane which provides controlled, quantified collapse upon exposure of an interior of said container to a partial vacuum, said collapse panel being surrounded by a land and having a width greater than 30 mm, said at least one collapse panel comprising a plurality of offset areas offset from said plane and one indented reinforcing rib extending within each of said plurality of offset areas, said ribs reducing distortion of said collapse panel while still permitting said quantified collapse.

14. The container of claim 13, wherein said material is heat-set polyethylene terephthalate.

15. The container of claim 13, wherein said material is a nitrile.

16. The container of claim 13, wherein said collapse panel has a length:width ratio of less than 4.

17. A thin-walled container made of thermoplastic material, comprising a bottom section, a neck section and a body section extending between said neck section and said bottom section, said body section having a cross-section substantially of a shape selected from the group consisting of square, rectangular, hexagonal, octagonal and round; said body section including at least one indented collapse panel extending in a plane which provides controlled, quantified collapse upon exposure of an interior of said container to a partial vacuum and which is surrounded by a land, a plurality of offset areas offset from said plane extending within said at least one collapse panel, and one indented reinforcing rib extending within each of said plurality of offset areas, said ribs reducing distortion of said collapse panel while still permitting said quantified collapse.

18. The container of claim 17, wherein said container is hot-fillable.

19. The container of claim 17, wherein said collapse panel has a length:width ratio of less than 4.

* * * * *